United States Patent [19]

Naimo

[11] 4,084,289

[45] Apr. 18, 1978

[54] GUIDE RAIL FOR SLIDING PANELS, DOORS AND THE LIKE

[75] Inventor: Jean-Pierre Naimo, Rillieux-la-Pape, France

[73] Assignee: A.T.M.B. Societe Anonyme, Puteaux, France

[21] Appl. No.: 758,788

[22] Filed: Jan. 12, 1977

[30] Foreign Application Priority Data

Jan. 14, 1976 France ..... 76 01485

[51] Int. Cl.[2] ..... A47H 1/04; A47H 15/00

[52] U.S. Cl. ..... 16/96 R; 16/87 R

[58] Field of Search ..... 16/96 R, 87 R, 94, 87.4, 16/95 R, 95 W, 97, 99, 100, 105; 104/106; 49/505, 410, 411

[56] References Cited

U.S. PATENT DOCUMENTS

| | | | |
|---|---|---|---|
| 2,068,674 | 1/1937 | Harvey | 16/96 R |
| 2,286,573 | 6/1942 | Ramsey | 16/96 R |
| 2,554,294 | 5/1951 | Conroy et al. | 16/96 R |
| 3,004,636 | 10/1961 | Shane | 16/96 |
| 3,042,960 | 7/1962 | Spork | 16/96 R |

FOREIGN PATENT DOCUMENTS

| | | | |
|---|---|---|---|
| 663,994 | 1/1952 | United Kingdom | 16/95 |

*Primary Examiner*—Ronald Feldbaum
*Attorney, Agent, or Firm*—Karl F. Ross

[57] ABSTRACT

Two parallel rails for the guidance of rollers or sliders on opposite edges of a panel, door or similar structural component comprise each a pair of elongated, substantially parallel members nestedly interfitted with a longitudinal internal clearance left therebetween to allow a change of their transverse separation and/or a limited relative tilting thereof. For this purpose the two members are joined to each other, at longitudinally spaced locations, by a plurality of adjustable connectors each comprising a male threaded element or bolt and a female threaded element or nut, each of these elements being anchored to a respective member. One member serves as a base, to be fixedly secured to a support, and the connector elements anchored thereto are nonrotatably held therein; the other member, forming a track, has a guide channel with an apertured bottom giving access to slotted or otherwise indented faces of the coacting connector elements to enable their rotation by a suitable tool such as a screwdriver.

12 Claims, 8 Drawing Figures

GUIDE RAIL FOR SLIDING PANELS, DOORS AND THE LIKE

FIELD OF THE INVENTION

My present invention relates to a rail for the guidance of slidable structurable components, such as panels, doors or partitions, used in the interior of a building.

BACKGROUND OF THE INVENTION

Such slidable components, especially those moving in vertical planes, are usually mounted in frames with upper and lower guide rails to be engaged by rollers or slides. These rails, which for satisfactory operation must be exactly parallel to each other, usually have a fixed distance which cannot be adjusted to compensate for manufacturing tolerances, shrinkage etc. of the supporting structure or of a prefabricated panel or door leaf to be guided thereby.

OBJECT OF THE INVENTION

The object of my present invention, therefore, is to provide an improved guide rail for the purpose described which can be conveniently adjusted to fit existing requirements in order to insure proper guidance with limited play.

SUMMARY OF THE INVENTION

I realize this object, in accordance with my present invention, by providing a guide rail divided into two parts, i.e. an elongate base member and an elongate track member extending substantially parallel to each other with an intervening longitudinal clearance. The base member, which can be fixedly secured to a floor, ceiling or other support, is joined to the track member at longitudinally spaced locations by two or more connectors each including a male threaded element or bolt and a female threaded element or nut matingly engaging each other. One of these threaded elements is nonrotatably anchored to the base member while the other is rotatably anchored to the track member for enabling limited changes in the separation of the two members at each of those locations.

For both esthetic and practical reasons (keeping dirt out and preventing drafts, for example) I prefer to provide one of the members with lateral wings bracketing the other member and enclosing the intervening clearance. These wings also improve the stability of the rail assembly by holding the two members in a nested relationship, with positive guidance in a transverse direction (i.e. vertically in the case more particularly envisaged).

The threaded connector element on the track member may have a slot or other formation engageable, through a suitable access opening in that member, by a tool such as a screwdriver or an Allen wrench. To prevent any displacement of that element along its axis of rotation, I prefer to provide it with retaining means bearing on a pair of spaced-apart contact surfaces of the track member. Advantageously, the retaining means may have convex opposite faces allowing for a limited rocking motion in a common longitudinal plane of the two members so that the track member can be tilted at a certain angle with reference to the associated base member if this should be necessary in order to make it parallel to the track member of the companion rail.

BRIEF DESCRIPTION OF THE DRAWING

The above and other features of my invention will now be described in detail with reference to the accompanying drawing in which.

SPECIFIC DESCRIPTION

Figure 1:
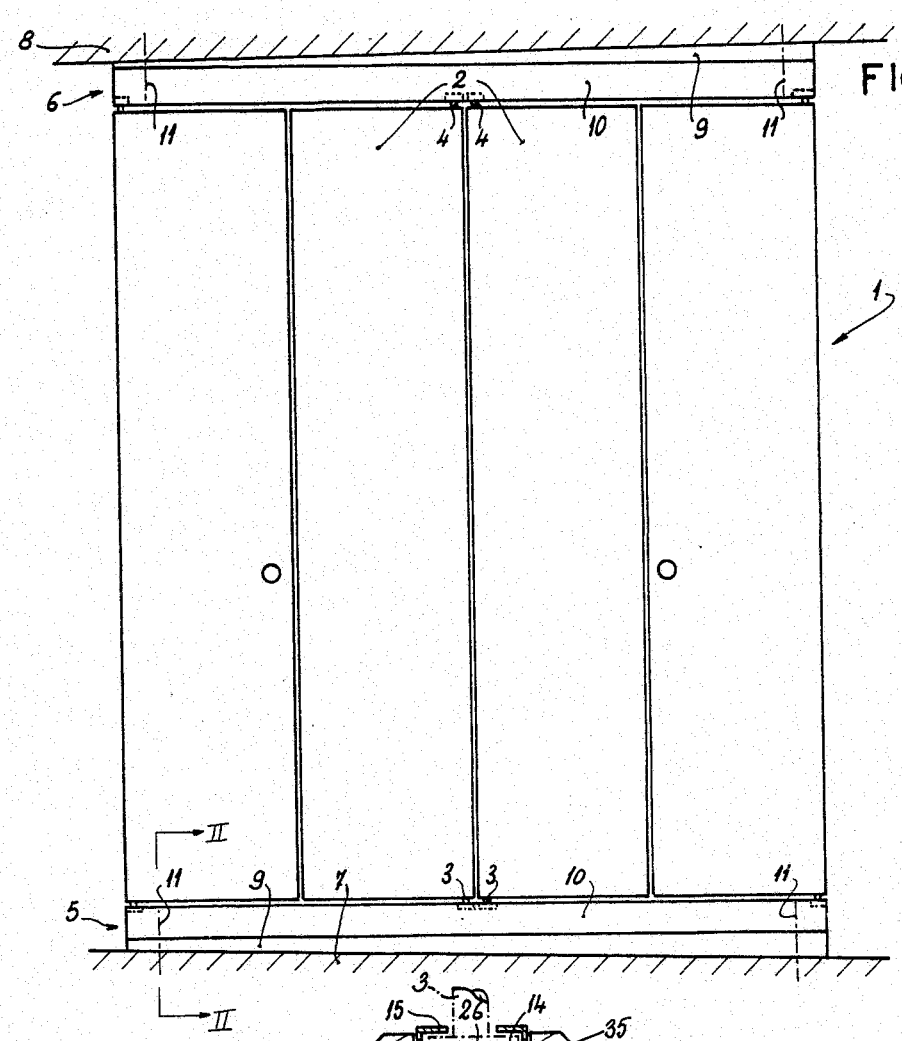
FIG. 1 is a side-elevational view of a folding door for a closet or cabinet guided in a pair of rails according to my invention.

In FIG. 1 I have shown a folding door 1 with two halves 2 each consisting of a pair of leaves hinged to each other, each leaf being provided with a lower and an upper guide roller 3, 4 slidable in a respective rail 5 or 6. The two rails are of identical construction and comprise each a base member 9 and a track member 10, members 9 of rails 5 and 6 being respectively secured to a floor 7 and a ceiling 8 in a manner more fully described hereinafter. The two longitudinally coextensive members 9 and 10 of each rail are joined to each other, near their ends, by a pair of adjustable connectors 11 which in FIG. 1 have been diagrammatically indicated by their vertical axes. Each connector 11 allows the relative vertical position of members 9 and 10 to be independently varied in order to compensate, for example, for a lack of parallelism between the supporting surfaces of floor 7 and ceiling 8 as exaggeratedly illustrated in FIG. 1.

Figure 2:
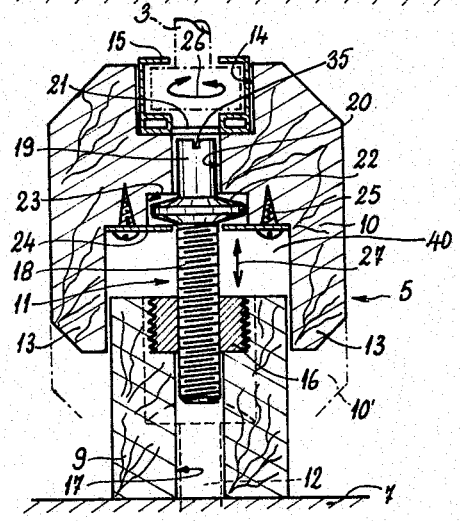
FIG. 2 is a cross-sectional view of the lower rail of FIG. 1, taken on the line II — II thereof and drawn to a larger scale.

FIG. 2 shows the structure of members 9 and 10 of lower rail 5 (which of course is also representative of upper rail 6) according to a first embodiment of my invention. Base member 9 is a wooden profile of rectangular cross-section attached to the floor 7 at a number of longitudinally spaced points by countersunk spikes 12. Track member 10 is also a wooden profile, of generally rectangular cross-section, with lateral wings 13 which bracket the base member 9 so that the latter is nested in the former, leaving a longitudinal clearance 40 between these members whose depth can be adjusted by the connector 11 as indicated by an arrow 27. Track member 10 has a longitudinal, upwardly open channel 14 which is lined by a metallic profile 15 designed to guide the rollers 3 of FIG. 1.

Connector 11 comprises a nut 16, representing its female element, and a mating bolt 18 constituting its male element. Nut 16 has external threads by which it is screwed into an enlarged upper end of a vertical bore 17 receiving the threaded stem of bolt 18. The bolt has a head 19 with a slot 35 engageable by a screwdriver through an aperture 21 in the bottom of guide profile 15 which is aligned with a cutout 20 loosely surrounding the head 19. Cutout 20 communicates with a space 23 accommodating a retaining collar 22 which is rigid with bolt 18 between its head 19 and its threaded stem; collar 22 has convex upper and lower faces which bear upon two contact surfaces forming the upper and lower boundaries of space 23, the lower contact surface being formed by a lid 24 secured to member 10 within clearance 40 by screws 25.

With nut 16 immobilized in base member 9, rotation of bolt 19 as indicated by an arrow 26 raises and lowers the track member 10 (arrow 27) whose lowermost position, determined by the depth of clearance 40, has been depicted in phantom lines at 10'. The convex curvature of the opposite faces of collar 22 insures that the bolt 18 is properly seated in member 10 even when that member is slightly tilted with reference to member 9.

Figure 3:
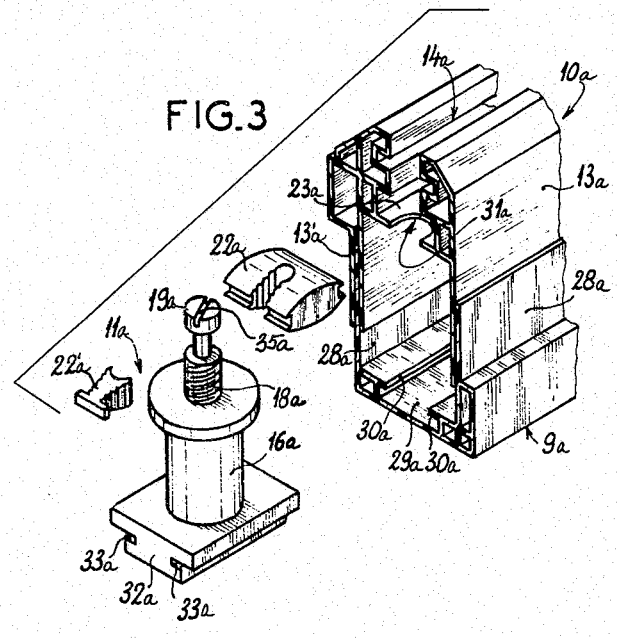
FIG. 3 is an exploded perspective view of part of a modified rail according to my invention.
Figure 4:
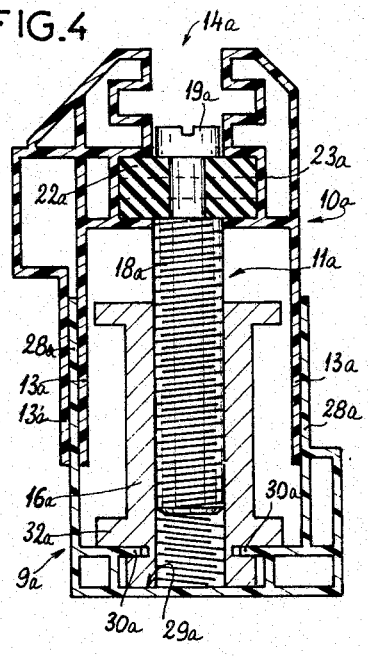
FIGS. 4 - 7 are cross-sectional views similar to FIG. 2, illustrating different embodiments.

In the embodiment of FIGS. 3 and 4, elements corresponding to those of FIG. 2 have been designated by the same reference numerals with the addition of a postscript *a*. Base member 9*a* and track member 10*a* are here molded from plastic material; connector 11*a* again has a nut 16*a* nonrotatably held in the base member and a mating bolt 18*a* rotatably supported in the track member. The slotted head 19*a* of this bolt adjoins a reduced neck to which a retaining collar 22*a* of rubber or the like is detachably secured, this elastic collar having the shape of a yoke which straddles the neck of bolt 18*a* and is slidably fitted into a channel 23*a* of track member 10*a*. A hole 31*a* in the bottom of that channel 23*a*, partly shown in FIG. 3, accommodates the threaded stem of bolt 18*a* with a rather loose fit permitting the aforedescribed rocking motion which is facilitated by the convex upper and lower surfaces of yoke 22*a*. The arms of that yoke are separated by a gap with corrugated sides into which a complementary insert 22'*a* can be fitted from above after the bolt has been properly positioned.

Nut 16*a* has a rectangular foot 32*a* formed with lateral grooves 33*a* which extend in the longitudinal direction of rail members 9*a*, 10*a* and receive guide ribs 30*a* of base member 9*a* overhanging a bottom channel 29*a*. Thus, the nut is again held nonrotatably in the base member which in this instance has upstanding lateral wings 28*a* bracketing the track member 10*a*; the latter is provided with a depending skirt 13'*a* engaging the left-hand wing 28*a* from the outside. The operation of connector 11*a* is analogous to that of connector 11 in FIG. 2.

Figure 5:
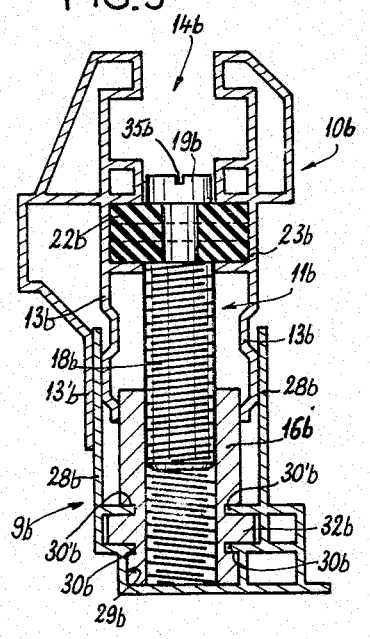

In FIG. 5 I have shown an assembly generally similar to that of FIGS. 3 and 4, albeit made of metal in this instance, in which corresponding elements have been designated by the same reference numerals with a subscript *b*. The profile of base member 9*b* has sidewalls provided with two pairs of guide ribs 30*b* and 30'*b* engaging in respective lateral grooves at the foot 32*b* of nut 16*b* forming part of connector 11*b*.

Figure 6:
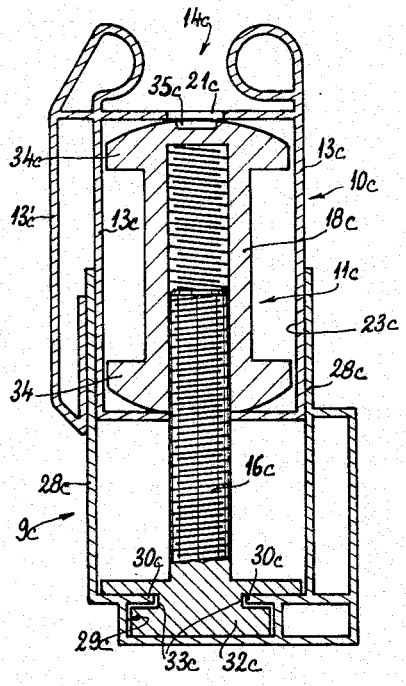

FIG. 6, in which elements having counterparts in preceding Figures have been designated by the same reference numerals with a subscript *c*, represents a reversal of the preceding arrangements in that the nonrotatable element 16*c* of connector 11*c*, anchored to base member 9*c*, is designed as a bolt whereas the rotatable element 18*c* in track 10*c* is a mating nut. The nut 18*c* has a lower cheek 34 and an upper cheek 34*c* whose convex faces bear upon lower and upper wall surfaces of channel 23*c*. The convex face of cheek 34*c* has a slot 35*c* engageable by a screwdriver via an aperture 21*c* at the bottom of guide channel 14*c*. Bolt 16*c* has a foot 32*c* with lateral grooves 33*c* receiving respective ribs 30*c* of base member 9*c*. Members 9*c* and 10*c*, shown to consist of metal, could also be made of plastic material.

Figure 7:
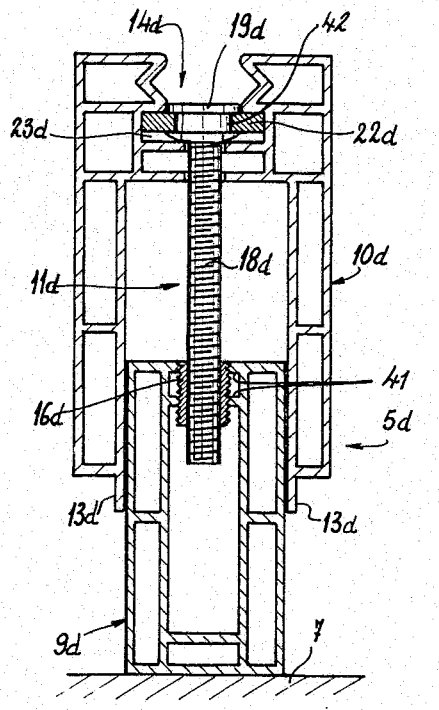
Figure 8:
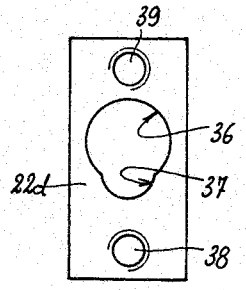
FIG. 8 is a plan view of a retaining plate used in the embodiment of FIG. 7.

In FIG. 7, where reference numerals with a postscript *d* are used to identify elements previously described, nut 16*d* of connector 11*d* is externally threaded (similarly to nut 16 of FIG. 2) and firmly engaged by mating threads on a pair of annular flanges 41 of base member 9*d*. Bolt 18*d* has a head 19*d* formed with a circular groove 42 embraced by a retaining plate 22*d* which, in a manner similar to that of collar 22*a* or 22*b* in FIGS. 3–5, engages the bolt 18*d* to prevent its axial displacement. Plate 22*d*, as shown in FIG. 8, has a cutout 36 which opens into a generally semicircular lobe 37, the latter having a radius only slightly exceeding that of groove 42 whereas cutout 36 is large enough to clear the head 19*d*. Thus, in order to anchor the bolt 18*d* to the track member 10*d*, retaining plate 22*d* is slid into channel 23*d* until its cutout 36 overlies the head 19*d* of the bolt which has been screwed into the nut 16*d*. Track member 10*d* is then lowered to let the head 19*d* penetrate the cutout 36 until its groove 42 is level with the plate 22*d*. Thereafter, the plate is longitudinally shifted in channel 23*d* until the grooved part of head 19*d* is embraced by the lobe 37. Threaded bores 38 and 39 in plate 22*d* receive nonillustrated screws which fit loosely into holes (not shown) at the bottom of channel 23*d* holding the lobe 37 centered on nut 16*d* while allowing limited rocking motion of bolt 18*d* in a plane longitudinally bisecting the two nested members 9*d* and 10*d* as in the preceding embodiments; the lower face of head 19*d* and the upper face of plate 22*d* may again have a convex curvature (spherical in the case of the head, cylindrical in the case of the plate) giving them a certain mobility. Head 19*d* also has a slot or a hexagonal indentation, not shown, for engagement by a tool.

The profiles constituting the two nested members 9*d*, 10*d* of rail 5*d* could be made either or metal, as shown, or of plastic.

It will thus be seen that I have disclosed a rail construction whose track member can be readily adjusted in its attitude relative to an associated base member, for proper spacing from and parallelism with a track member of a similarly constructed companion rail co-operating with it in the guidance of a door or the like.

I claim:

1. A rail for the guidance of a sliding structural component, comprising:

an elongate base member fixedly securable to a support;

an elongate track member extending substantially parallel to said base member with an intervening longitudinal clearance and with a longitudinally extending guide channel parallel to said clearance slidingly engageable with said component; and a plurality of adjustable connectors joining said members to each other at longitudinally spaced locations, each connector including a male threaded element and a female threaded element matingly engaging each other, one of said threaded elements being nonrotatably anchored to said base member, the other of said threaded elements being rotatably anchored to said track member for enabling limited changes in the separation and relative orientation of said members at any of said locations.

2. A rail as defined in claim 1 wherein said other of said elements is provided with retaining means, said track member having a pair of spaced-apart contact surfaces receiving said retaining means between them and holding said other of said elements against displacement in the direction of its axis of rotation.

3. A rail as defined in claim 2 wherein said retaining means is formed with two convex opposite faces bearing upon said contact surfaces with freedom of limited rocking motion in a common longitudinal plane of said members.

4. A rail as defined in claim 2 wherein said one of said elements is a nut and said other of said elements is a bolt, said retaining means comprising a collar surrounding said bolt.

5. A rail as defined in claim 4 wherein said bolt has a head projecting through an aperture in one of said contact surfaces and having a formation engageable by a tool, said guide channel communicating with said aperture for giving access to said formation.

6. A rail as defined in claim 5 wherein said collar is rigid with said bolt, said other of said surfaces being formed by a lid detachably secured to said track member to facilitate insertion of said collar.

7. A rail as defined in claim 5 wherein said bolt has a reduced neck adjacent said head, said collar comprising a yoke straddling said neck and a complementary part removably engaged by said yoke.

8. A rail as defined in claim 5 wherein said head is provided with an annular groove, said collar being a plate with a generally circular cutout large enough to clear said head and with a substantially semicircular lobe open toward said cutout having a radius slightly exceeding that of said groove but insufficient to clear said head, said plate being shiftable between said contact surfaces and being provided with fastening means for holding said lobe aligned with said nut.

9. A rail as defined in claim 4 wherein said nut is provided with external threads securing it to said base member.

10. A rail as defined in claim 2 wherein said one of said elements is a bolt and said other of said elements is a nut, said retaining means comprising a pair of oppositely facing cheeks on said nut bearing upon said contact surfaces, one of said cheeks having a formation engageable by a tool, said guide channel having an apertured bottom giving access to said formation.

11. A rail as defined in claim 2 wherein said one of said elements is provided with a generally rectangular foot provided with lateral grooves, said base member having sidewalls embracing said foot and forming guide ribs engaging in said grooves.

12. A rail as defined in claim 1 wherein one of said members has lateral wings extending past said longitudinal clearance and bracketing the other of said members between them.

* * * * *